US011303040B2

(12) United States Patent
Stumme et al.

(10) Patent No.: US 11,303,040 B2
(45) Date of Patent: Apr. 12, 2022

(54) CONFORMAL PHASED ARRAYS

(71) Applicant: The Government of the United States of America, as represented by the Secretary of the Navy, Arlington, VA (US)

(72) Inventors: Anna Stumme, Washington, DC (US); William Mark Dorsey, Ellicott City, MD (US); John Logan, Fairfax, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 34 days.

(21) Appl. No.: 16/869,044

(22) Filed: May 7, 2020

(65) Prior Publication Data

US 2020/0358206 A1 Nov. 12, 2020

Related U.S. Application Data

(60) Provisional application No. 62/845,013, filed on May 8, 2019.

(51) Int. Cl.
*H01Q 21/20* (2006.01)
*H01Q 13/02* (2006.01)

(52) U.S. Cl.
CPC ..... *H01Q 21/205* (2013.01); *H01Q 13/0208* (2013.01)

(58) Field of Classification Search
CPC ..... H01Q 21/205; H01Q 21/0025; H01Q 13/0208; H01Q 9/28; H01Q 25/001
See application file for complete search history.

(56) References Cited

U.S. PATENT DOCUMENTS 4,458,250 A 7/1984 Bodnar et al.
9,716,309 B1 * 7/2017 ElSallal ..... H01Q 25/00
(Continued)

FOREIGN PATENT DOCUMENTS

KR 101709074 B1 * 2/2017 ..... H01Q 13/18

OTHER PUBLICATIONS

Chen et al., "Broadband high-gain microstrip array antennas for WiMAX base station," IEEE Trans. Antennas Propag., vol. 60, No. 8, Aug. 2012, 4 pages.

(Continued)

*Primary Examiner* — Hoang V Nguyen
(74) *Attorney, Agent, or Firm* — US Naval Research Laboratory; Hong-Vinh Nguyen

(57) ABSTRACT

Embodiments are directed configurations of antenna elements for conformal phased arrays (e.g., circular or cylindrical) to support either omnidirectional or directional high-gain beams. Antenna elements may be spaced about a circle or cylinder with a vertical and circumferential element spacing that is based on a wavelength of an operational frequency. Such a configuration of antenna elements enables easy scaling to different frequency bands and a straightforward extension from single-linear to dual-linear polarization. Furthermore, the antenna elements and their configurations enable conformal phased arrays to be formed as one integrated structure or with multiple modular structures.

20 Claims, 4 Drawing Sheets

(56) References Cited

U.S. PATENT DOCUMENTS

| | | | | |
|---|---|---|---|---|
| 2002/0113743 | A1* | 8/2002 | Judd | H01Q 3/2647 343/757 |
| 2003/0052828 | A1 | 3/2003 | Scherzer et al. | |
| 2017/0125918 | A1* | 5/2017 | Howard | H01Q 21/06 |

OTHER PUBLICATIONS

Mahler et al., "Design and optimisation of an antenna array for WiMAX base stations," in IEEE/ACES International Conference on Wireless Communications and Applied Computational Electromagnetics, 2005., Apr. 2005, 4 pages.
Rappaport et al., "Millimeter wave mobile communications for 5G cellular: It will work!" IEEE Access, vol. 1, 2013, 15 pages.
Zhang et al., "5g millimeter-wave antenna array: Design and challenges," IEEE Wireless Communications, vol. 24, No. 2, 2017, 7 pages.
Huang et al., "Development of a wideband and high-efficiency waveguide-based compact antenna radiator with binder-jetting technique," IEEE Transactions on Components, Packaging and Manufacturing Technology, vol. 7, No. 2, Feb. 2017, 7 pages.
Zhou et al., "Wideband antenna array with full metal structure and air-filled microstrip feeding network," IEEE Trans. Antennas Propag., vol. 65, No. 6, Jun. 2017, 8 pages.
Geterud et al., "Lightweight waveguide and antenna components using plating on plastics," in 2013 7th European Conference on Antennas and Propagation (EuCAP), Apr. 2013, 4 pages.
Spence et al., "Additively manufactured ultrawide-band, wide scan, monolithic vivaldi arrays," in IEEE International Symp. on Antennas and Propag., Jul. 2017, 2 pages.
Fulton et al., "A computer-aided technique for the analysis of embedded element patterns of cylindrical arrays," IEEE Antennas and Propagation Magazine, vol. 57, No. 3, Jun. 2015, 7 pages.
Gomez-Torrent et al., "A study of the additive manufacturing technology for RF/microwave components," in European Conference on Antennas and Propagation (EUCAP), Mar. 2017, 5 pages.
Zhang et al., "Investigation on 3-d-printing technologies for millimeter-wave and terahertz applications," Proceedings of the IEEE, vol. 105, No. 4, Apr. 2017, 14 pages.
Kindt et al., "Ultrawideband all-metal flared-notch array radiator," IEEE Transactions on Antennas and Propagation, vol. 58, No. 11, Nov. 2010, 8 pages.
Stumme et al., "Additively-manufactured cylindrical array with snap-fit connector integration," in IEEE International Symp. on Antennas and Propag., Jul. 2019, 2 pages.
Dorsey et al., "Uniform circular array pattern synthesis using second-order cone programming," IET Microwaves, Antennas Propagation, vol. 9, No. 8, 2015, 5 pages.
Coleman et al., "Phase-shift steer a uniform circular array in the fourier-series domain," in Wireless and Microwave Technol-ogy Conference (WAMICON), Apr. 2017,4 pages.
Dorsey et al., "3-D-Printed Circular Array for WiMAX Base Station," in IEEE Antennas and Wireless Propagation Letters, vol. 18, No. 6, Jun. 2019, 5 pages.

* cited by examiner

CONFORMAL PHASED ARRAYS

CROSS-REFERENCE TO RELATED APPLICATIONS

This Application claims the benefit of U.S. Provisional Application No. 62/845,013 filed on May 8, 2019, the entirety of which is incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, D.C. 20375, USA; +1.202.767.7230; techtran@nrl.navy.mil, referencing Navy Case #111112-US2.

BACKGROUND

Worldwide Interoperability for Microwave Access (WiMAX®) provides broadband connectivity to fixed and/or mobile users, and a single base station is responsible for covering a cell much larger than what could be covered by traditional Wi-Fi® systems. Similar challenges face 5G communication systems tasked with providing increased data rates to an ever-growing consumer base. In addition, WiMAX® and 5G wideband antennas require directional radiation patterns over a full 360 degrees to enable suitable performance to users within a given cell; on-the-fly adjustment of sector coverage to support mobile users; and the ability to adjust antenna gain and transmit power.

Conventional base station antennas for WiMAX® and/or 5G base stations are omnidirectional (radiate the same power over 360 degrees) or sectorized (radiate in a broad sector in angle). In either case, the signal transmitted from the base station antenna is not focused towards a specific user or device/node. Instead, the signal is spread out over a wide range of angles, which has several disadvantages. First, spreading the signal over a much wider than necessary range of angles reduces the power levels at a desired receive node. Second, transmitting the signal over a wider than desired region increases the potential interference at a desired receive node. Both of these factors degrade antenna performance.

Common traditional base station antennas include panel antennas, omnidirectional antennas and dipole arrays. A panel antenna is designed for a specific broad beamwidth with a customized pattern to reduce interference in adjacent cells. The panel antenna may include multiple antennas arranged about a mast/tower with the number of panels dependent on the beamwidth. An omnidirectional antenna radiates in all directions with no beamforming or interference mitigation capability. A dipole array is a single polarized antenna and is formed with vertical dipoles arranged about a central mast. The dipole array provides limited bandwidth coverage with potential for null-steering to mitigation interference. However, these conventional antennas do not provide the ability to adapt to a changing environment, customize coverage, or control dynamic interference.

Studies suggest millimeter wave (mmW) mobile communications as a solution for 5G mobile communications systems, where directional base station patterns fix problems with atmospheric attenuation and interference. Directional antenna architectures capable of 360-degree steering are seen as critical technology enablers for mmW cellular systems, and circular arrays have been shown to outperform traditional arrays in these areas. However, existing circular/cylindrical arrays are single polarized, narrow band and/or have high gain elements with wide inter-element spacing. Moreover, dual-polarized designs typically require compromised performance in one polarization compared to another.

Another challenge with the existing antenna technology is the antenna elements not being extensible to non-planar arrays and/or meeting growing demands of increased bandwidth or wideband operations. Low profile elements have been used (e.g., printed circuit elements, long elements) to achieve bandwidth, but typically at the expense of limited power handling. Furthermore, existing elements (e.g., of planar arrays) do not conform to a wedge-shaped cell of a cylindrical array, leading to contact gaps between adjacent elements, particularly in the elevation plane, that disrupt performance. Additionally, wideband elements are often long, making them a challenge to integrate into the wedge-shaped cell. Moreover, conventional elements are constructed separately and then manually assembled, which is a complicated and time-consuming process.

SUMMARY

Embodiments are directed configurations of antenna elements for conformal phased arrays (e.g., circular or cylindrical) to support either omnidirectional or directional high gain beams. Antenna elements may be spaced about a circle or cylinder with a vertical and circumferential element spacing that is based on a wavelength of an operational frequency. Such a configuration of antenna elements enables easy scaling to different frequency bands and a straightforward extension from single-linear to dual-linear polarization. Furthermore, the antenna elements and their configurations enable conformal phased arrays to be formed as one integrated structures or with multiple modular structures.

In one embodiment, a wideband antenna array is described. The wideband antenna array includes a first set of antenna elements arranged in a circular manner to form a first tier, each element of the first set of antenna elements having at least one excitation port and is configured to be separately excitable via the at least one excitation port; and wherein the wideband antenna array is configurable to operate in at least one of an omnidirectional mode, a sectorized mode, or a high-gain directional mode.

Optionally, the wideband antenna array is configured to enable the formation of directional beams throughout 360 degrees of azimuth coverage without degradation to gain or sidelobe level.

Optionally, the circumferential spacing of the first set of antenna elements is based on a wavelength of a highest operational frequency of the wideband antenna array.

Optionally, the height of each element is based on a wavelength of a highest operational frequency of the wideband antenna array.

Optionally, the first set of antenna element is in a vertical arrangement and supports vertical polarization.

Optionally, the wideband antenna array further includes a second set of antenna elements arranged in a circular manner to form a second tier; wherein the first tier and the second tier are vertically arranged to form a cylinder.

Optionally, the wideband antenna array further includes a conductive wall between the first tier and the second tier.

Optionally, the first set of antenna elements is in a dual-slant arrangement and supports orthogonal slant polarization.

Optionally, the wideband antenna array further includes a second set of antenna elements arranged in a circular manner to form a second tier, the second set of antenna elements being in a dual-slant arrangement; wherein the first tier and the second tier are vertically arranged to form a cylinder.

Optionally, each element comprises a quadrature-type element having four excitation ports and supports dual-polarization.

Optionally, the wideband antenna array further includes a second set of quadrature-type antenna elements arranged in a circular manner to form a second tier; wherein the first tier and the second tier are vertically arranged to form a cylinder.

Optionally, each element is configured to conform to a wedge-shaped unit cell.

Optionally, each element is formed with a plastic material and is electroplated.

Optionally, each element is formed with a metal.

Optionally, the first tier is configured to be formed by one or more modular structures.

Optionally, at least the first tier is configured to be formed as an integrated structure.

Optionally, each element comprises a stepped notch element.

In another embodiment, a conformal phased array is described. The array includes a plurality of quadrature-type elements, each element conforming to a wedge-shaped cell and comprising a plurality of conductive extrusions that provide mechanical support and continuity between adjacent elements; wherein the conformal phased array is configured to form directional beams throughout 360 degrees of azimuth coverage.

Optionally, each element further comprises a plurality of excitation ports to support dual-polarization.

Optionally, the conductive extrusions are in the elevation plane.

Further features and advantages of the invention, as well as the structure and operation of various embodiments are described in detail below with reference to the accompanying drawings.

DETAILED DESCRIPTION

Definitions

Figure 1:
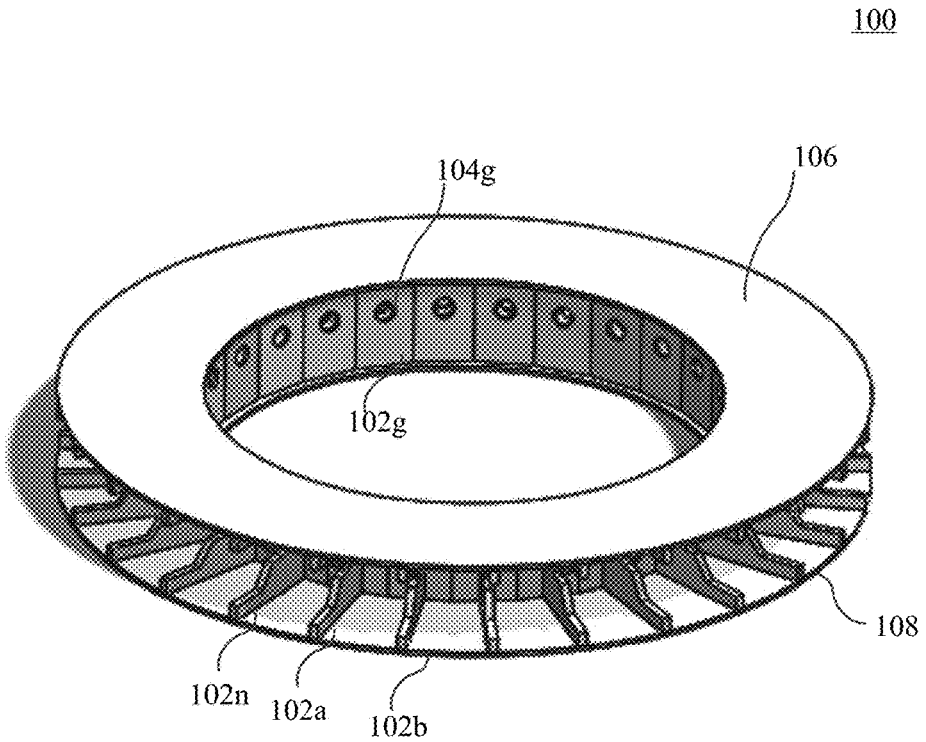
FIG. 1 depicts an exemplary circular array in a perspective view.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, it is submitted that it is within the knowledge of one skilled in the art to effect such feature, structure, or characteristic in connection with other embodiments whether or not explicitly described.

In describing and claiming the disclosed embodiments, the following terminology will be used in accordance with the definition set forth below.

As used herein, the singular forms "a," "an," "the," and "said" do not preclude plural referents, unless the content clearly dictates otherwise.

As used herein, the term "and/or" includes any and all combinations of one or more of the associated listed items.

As used herein, the term "about" or "approximately" when used in conjunction with a stated numerical value or range denotes somewhat more or somewhat less than the stated value or range, to within a range of ±10% of that stated.

Terminology used herein should not be construed as being "means-plus-function" language unless the term "means" is expressly used in association therewith.

Antenna gain of an antenna is used to describe how much power is transmitted in the direction of peak radiation to that of an isotropic source (a theoretical source that radiates the same intensity of radiation in all directions). Thus, for example, a transmitting antenna with a gain of 3 decibel (dB) means the power received at a node away from the antenna will be 3 dB higher (twice as much) than what would be received from an isotropic antenna that is lossless. As another example, a receive antenna with a gain of 3 dB may receive 3 dB more power in a given direction than a lossless isotropic antenna. Usually, when the desired signal is known to be coming from a particular direction, it would be better to have maximum gain towards that direction. But, when the direction is not known, it may be better to have a low gain antenna in this case.

The radiation patterns of an antenna may be characterized by beamwidths and applicable sidelobe levels. A main beam is a region formed around the direction of maximum radiation (e.g., the region within 3 dB of the peak of the main beam), whereas sidelobes are smaller beams that are away from the main beam. A sidelobe is usually radiation in an undesired direction which simply cannot be eliminated. Sidelobe level characterizes radiation patterns, thus the sidelobe level (SLL) parameter is the maximum value of the sidelobes (away from the main beam).

Antennas are usually designed to receive and transmit radio waves (composed of both electric and magnetic fields) that are polarized in a specific way. Polarization of a radio wave is the direction of oscillation of the electric field component when the radio wave is propagating in a medium. A radio wave is linearly polarized when the electric field is oscillating in the horizontal or vertical direction. Another form of linear polarization is when the electric field oscillates at ±45 degrees from a reference plane of 0 degrees, and this polarization is slant. Circular polarization occurs when a radio wave rotates as the signal propagates. A circularly polarized wave includes two perpendicular (orthogonal) electromagnetic plane waves of equal amplitude that are 90 degree out of phase. Circular polarization is generally desired as there is no polarization mismatch between two antennas that are both circularly polarized.

Overview

Embodiments are directed to wideband, low gain radiating elements with circumferential and vertical spacing being dependent on the wavelength of the highest frequency of operation, particularly a half wavelength or less. By using this element spacing, these antenna configurations maintain optimal performance in terms of pattern characteristics and scanned beam characteristics. The antenna configurations described herein enable a full 360-degree coverage, which may be omnidirectional in nature or may include steerable directional beams. The scanned pattern may remain unchanged in terms of beamwidth, sidelobe level, and polarization as a function of steering angle. Thus, these antenna configurations are ideal for base station antenna systems, given the 360-degree visibility with radiation pattern agility. The antenna configurations are beneficial to WiMAX® and 5G base stations as they offer variable gain antenna patterns to allow the range of the base stations to be increased as well as mitigation of interference while enabling line-of-sight (LOS) communications. However, the described concepts are not limited to WiMAX® or 5G base stations.

Another antenna parameter is bandwidth, which is the range of frequencies over which the antenna can properly radiate or receive energy. The bandwidth for antennas may vary widely. For example, as mentioned above, many antenna types have narrow bandwidths and thus cannot be used for wideband operations.

Examples

FIG. 1 depicts an exemplary circular array 100 in a perspective view. Array 100 may be used in an antenna system, for example, for a base station. Array 100 includes a plurality of antenna elements 102*a*-102*n* arranged in a circular manner (i.e., about a circle). Array 100 may cover one or more operational frequency bands, for example, the 5.1-5.8 GHz WiMAX® band or the 2.4-4.2 GHz 5G band. Array 100 may include conductive wall 106 on the top and conductive wall 108 on the bottom to enhance performance, although these walls may not be required in all configurations. Walls 106 and 108 may enhance polarization performance for a single-polarization design and serve as placeholders for orthogonal polarization in a dual-polarization design.

Each of elements 102*a*-102*n* may include at least one excitation port and is configured to be separately excitable via the at least one excitation port. For example, as shown in FIG. 1, antenna element 102*g* may include an excitation port 104*g*. An active beam forming network may deliver an appropriate amplitude and phase to elements 102*a*-102*n*, via the excitation ports, and an antenna pattern may be configured and/or reconfigured to improve system performance. That is, different beams may be formed with the appropriate weights/excitations, which may be determined by various methods. For example, if the response from each element is $f_n$, where n is an index defining the element, then the overall response of array 100 (or any set of elements within array 100) is the sum of $w_n*f_n$, where $w_n$ is the weight applied to the signal for element n. This weight contains both amplitude and phase control. In an example where array 100 is a receive array, the output of each element may be delivered to a beamformer subsystem (e.g., circuit) that may include amplitude control (e.g., an attenuator or amplifier) and phase control (e.g., phase shift or time delay) for both transmission and reception of radio frequency (RF) signals. The outputs of the elements may be combined to generate a final output. Alternatively, the output of each element may be digitized and the amplitude control and phase control may be combined digitally. In an example where array 100 is a transmit array, phase control may be utilized and amplitude control may be minimized or not used because it may waste power.

Accordingly, one set of element weights (amplitude and/or phase) may enable an omnidirectional beam to be formed, a second set of element weights may enable a sectorized beam to be formed, and a third set of element weights may enable a high-gain directional beam to be formed. Array 100 may therefore operate in different modes: omnidirectional mode, sectorized mode, and high-gain directional mode. An omnidirectional mode may provide near-constant gain over a full 360 degrees. For example, in the omnidirectional mode, all elements may be excited with the same amplitude and/or phase (e.g., $w_n$=1 for all n). In the omnidirectional mode, coverage may be provided to all users/nodes, albeit with a low gain that may ultimately limit range. A sectorized mode may provide constant gain over a wide angular sector but less than the omnidirectional mode. For example, the desired elements may be excited or turned on (e.g., $w_n$=1 for all these desired elements) while the remaining elements may be turned off (e.g., $w_n$=0 for all the remaining elements). In the sectorized mode, coverage may be restricted to a specific range with improved gain/range within the restricted range. Directional mode may focus the beam in a specific direction. For example, a directional pattern may be obtained by proper phasing of the elements. Amplitude control may also be used to allow control of pattern shape and sidelobes. The directional mode is useful when the location of a desired receive node has been determined, and the antenna may operate in this mode to maximize gain and minimize interference. Other techniques may be used for element excitation for the different modes, and the design of a particular array may influence and/or affect the technique to be used and/or the output of the array. For example, if the elements are spaced too far apart, a ripple may be formed in the amplitude of the pattern.

To maximize the power delivered to a receive node (e.g., a WiMAX® one), it may be desirable for transmit patterns to have a maximum effective radiated power (ERP). This type of pattern may be formed in any direction and provides a benefit over traditional antennas that transmit (or receive) only omnidirectional or sectorized patterns.

As shown in FIG. 1, elements 102*a*-102*n* are vertically arranged around array 100 and support linear polarization or vertical polarization. Other configurations of elements 102*a*-102*n* are possible and will be described in connection with subsequent figures. In an embodiment, the circumferential and vertical spacing (i.e., the height of the element) of elements 102*a*-102*n* may depend on a wavelength, for example, a half wavelength of the highest operational frequency of array 100. The half-wavelength sampling here is beneficial as it allows array 100 to operate as a wideband antenna and to form directional beams at any azimuthal pointing direction with no variation to beamwidth or sidelobe level. This ensures that receive nodes in any direction around the axis of array 100 can receive the same transmitted pattern, and thereby experience the same performance.

The size (e.g., radius and height) of array 100 may be driven by physical limitations (e.g., limitations placed on a base station tower), with larger array sizes offering opportunity for more gain. The antenna element size (e.g., height) and/or spacing may dictate the overall frequency range of operation and polarization of the antenna used for a particular application (e.g., a base station). For example, an array with an outer diameter of 9.0 may include elements with a height of 1.2 inches (3.05 cm, 0.6 wavelengths) for an operational frequency of 6.0 GHz. A base station may be a multi-sector base station designed to support more than one sector, and may be used in service areas where large numbers of users are grouped into different sections. An outdoor subscriber station may include antennas that are mounted on roof tops, towers, hill tops, depending on the type of terrain and desired coverage area. Thus, depending on the needs of a base station, an appropriately sized antenna array may be designed with the appropriate software control to address those needs. For example, software may be used to adjust antenna gain characteristics and the radiated transmit power to conform to local regulatory limits and reduce noise interference in large networks.

Array 100 may be built using known technologies, for example, additive manufacturing or 3D printing or machined out of metal. For example, array 100 may be additively manufactured with a selective laser sintering or stereolithography printer. In an embodiment, array 100 may be 3D-printed with plastic (e.g., nylon powder) and then electroplated with copper to provide an effectively all-metal radiator. In an embodiment, array 100 may be built in its entirety as an integrated structure. In another embodiment, array 100 may be formed from one or more modular structures (e.g., elements, wedges, sections, tiers) that are assembled together. Thus, array 100 has the benefit of an all-metal design for increased power handling. The manufacturing techniques and materials disclosed are not intended to be limiting, other materials and manufacturing techniques, including fewer or additional processing steps and materials may be utilized.

Figure 2:
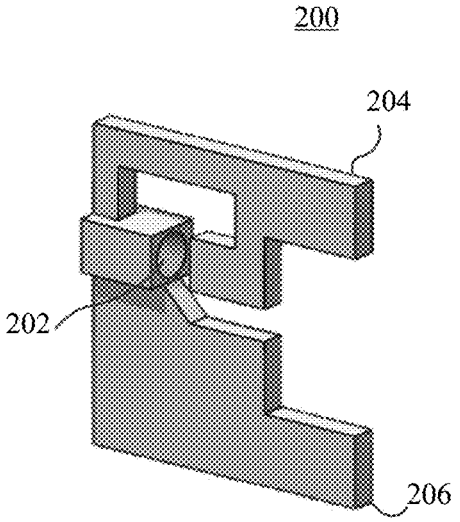
FIG. 2 depicts an exemplary stepped notch element in a perspective view.

FIG. 2 depicts an exemplary stepped notch element 200 in a perspective view. Element 200 may include an excitation port 202 and two protruding tips 204 and 206. In an embodiment, array 100 may be formed of stepped notch antenna elements such as element 200. In this embodiment, elements 102*a*-102*n* are designed to enable transmission/reception of vertical polarization over WiMAX frequencies of 5.1-5.8 GHz. It is a straightforward exercise to scale this design to operate in other frequency ranges by varying the inter-elemental spacing. Moreover, element 200 may be modified to a longer stepped notch element with more steps to increase the fractional bandwidth of an antenna to allow it to support more frequency bands.

Figure 3:
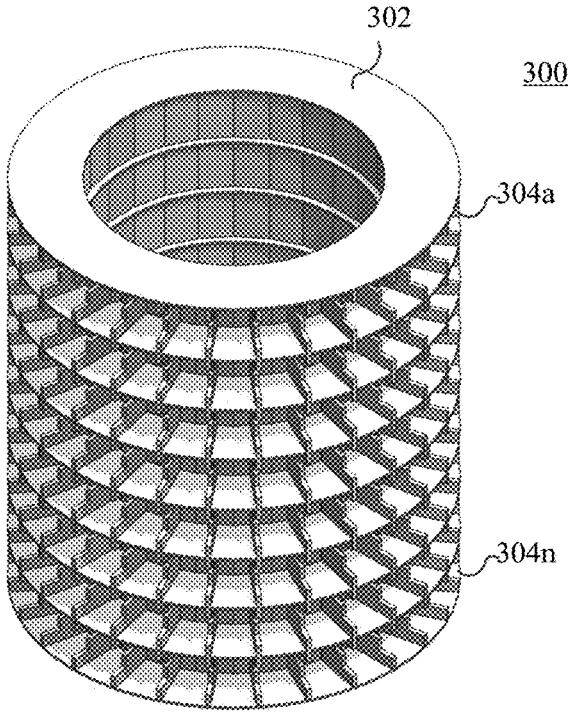
FIG. 3 depicts an exemplary cylindrical array in a perspective view.

The vertical height of element 200 allows for stacking multiple tiers (e.g., array 100 shown in FIG. 1 may constitute a tier) vertically to form a cylindrical array capable of wide-angle scanning in elevation. FIG. 3 depicts an exemplary cylindrical array 300 in a perspective view. As shown in FIG. 3, array 300 is formed of eight tiers 304*a*-304*n*, although more or fewer tiers may be used. Each tier, for example, tier 304*a* may be built (e.g., machined, additive manufactured) as a modular structure and then stacked together vertically to create array 300. Alternatively, array 300 in its entirety may also be built as an integrated structure, for example, by additive manufacturing. Array 300 may further include a conductive wall, for example wall 302 shown in FIG. 3, between each tier. Wall 302 enhances polarization and bandwidth performance for a single-polarized design while also serving as a place holder for the integration of a second orthogonal polarization. In an embodiment, a second orthogonal polarization may be inserted in place of conductive wall 302 between tiers 304*a*-304*n* of array 304 to allow transmission of dual-linear and/or circular polarization. For example, conductive wall 302 may be replaced by horizontally-polarized elements (e.g., a set of horizontally arranged stepped notch elements placed around array).

The ability to scan in elevation allows array 300 to maximize the signal amplitude on a desired receive node. The cylindrical geometry of array 300 makes this a great receive array for determining the direction of arrival (DoA) of an incoming signal, thus allowing array 300 to determine the required pointing direction to maintain a high-gain line-of-sight (LOS) communication with the desired node. Accordingly, array 300 allows a more directional beam in elevation that may be steered vertically and yields better performance as a cylindrical array than conventional arrays.

Figure 4:
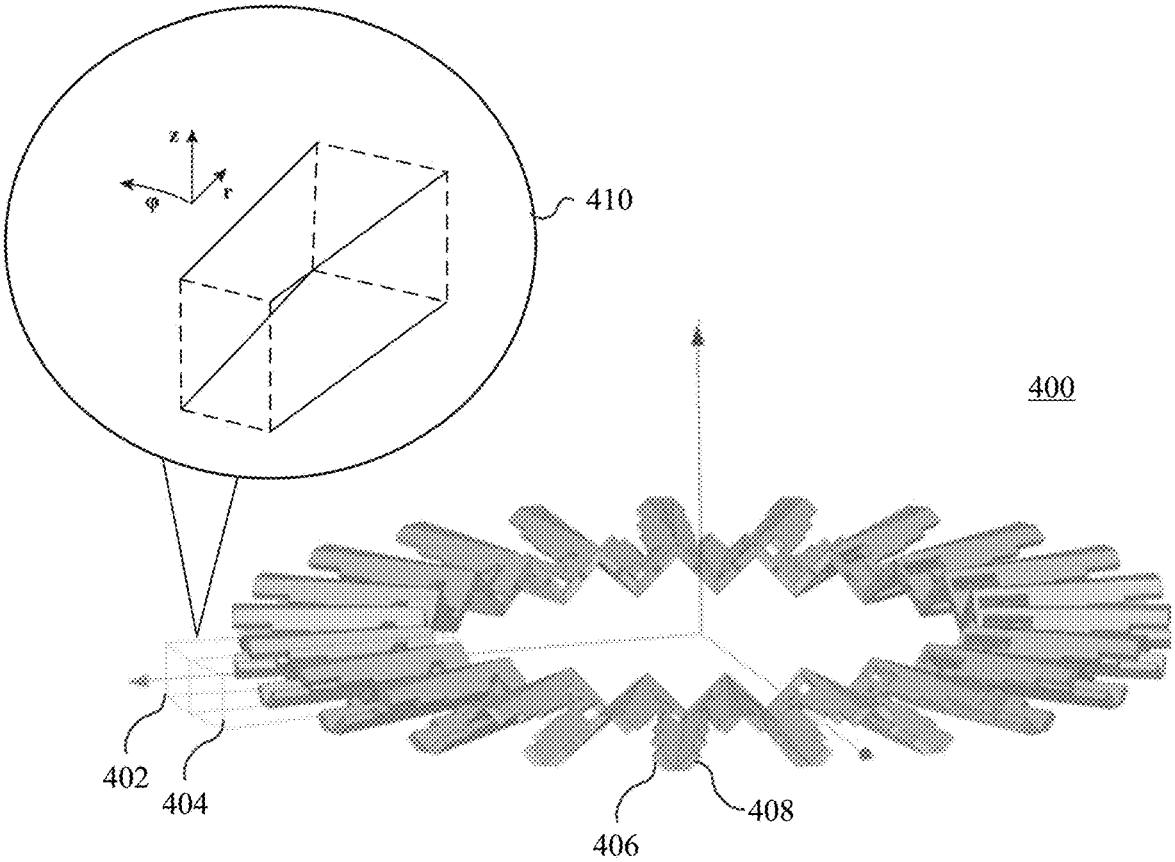
FIG. 4 depicts an exemplary circular array in a perspective view.

Conformal phased arrays are not limited to the configurations described above, many other element designs and configurations may be used. FIG. 4 depicts an exemplary dual-slant polarized circular array 400 in a perspective view. Array 400 utilizes longer stepped notched elements (e.g., element 406 and element 408) to achieve a wider operational bandwidth. Thus, array 400 may be used as a wideband antenna, suitable for WiMAX® and/or 5G applications. Array 400 also uses dual-polarized elements arranged at orthogonal slant polarization instead of the horizontal/vertical polarization used in array 300, shown in FIG. 3. As shown in FIG. 4, element 406 is slanted to the left and element 408 is slanted to the right, and this alternating slant pattern repeats throughout the entire circle that forms array 400. Two exemplary unit cells 402 and 404 are shown in FIG. 4. Unit cell 402 is shown more clearly in magnified view 410 as a wedge-shaped unit cell, with non-parallel side walls, to which an antenna element conforms. In this manner, array 400 may be formed of uniformed modular elements/unit cells or wedges for ease of design and assembly. This design may be easier to implement than attempting to arrange longer elements around a circle in both vertical and horizontal directions to enable dual-linear polarization. In a different array configuration (e.g., planar) unit cell 402 may be a rectangular unit cell. Generally, the unit cell may be designed by taking into consideration the size and/or shape of the conformal phased array and available manufacturing technologies, such that when the element is duplicated and/or assembled, there is continuity between adjacent elements.

Figure 5:
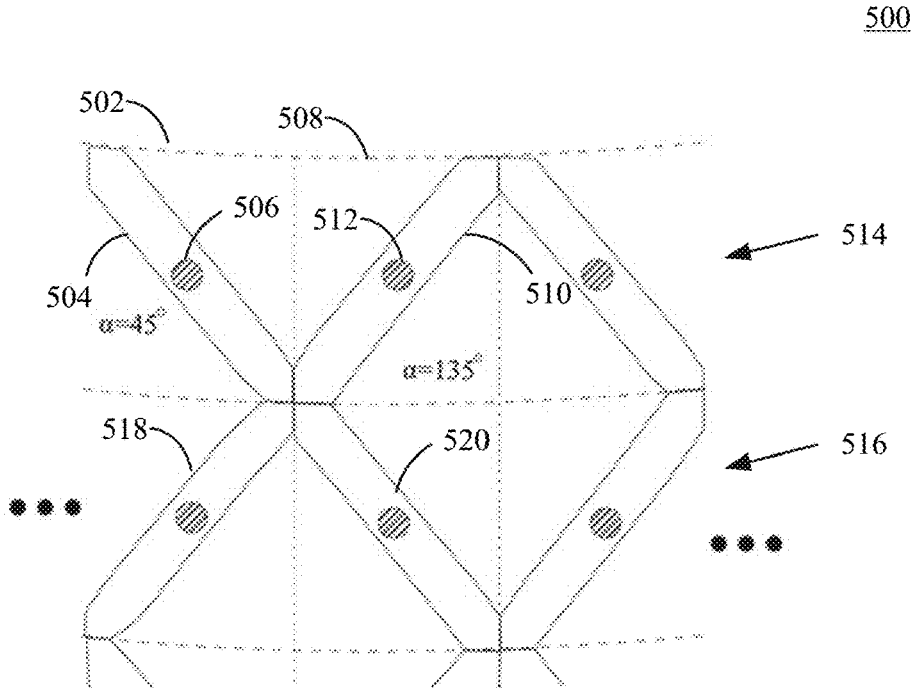
FIG. 5 depicts an exemplary cylindrical array formed with dual-polarized elements in an orthogonal view.

Similar to array 100, array 400 may be duplicated vertically to form a cylindrical array. FIG. 5 depicts an exemplary cylindrical array 500 formed with dual-polarized elements in an orthogonal view. As shown in FIG. 5, array 500 includes tiers 514 and 516, although more tiers may be included. Array 500 includes a plurality of elements arranged at orthogonal slant polarization to support dual-linear polarization. For example tier 514 includes elements 504 and 510 and tier 516 includes elements 518 and 520. As shown in FIG. 5, element 504 conforms to unit cell 502, and element 510 conforms to unit cell 508. Element 504 is adjacent to element 510 and they are slanted to the left and to the right, respectively. Thus, element 504 has a polarization or tilt angle of 45 degrees and element 510 has a polarization angle of 135 degrees. Tier 514 is stacked with an offset of one unit cell on tier 516 to form array 500. In other words, tier 514 is not merely stacked directly on top of tier 516. Rather, tier 514 is rotated and then stacked onto tier 516 such that element 504, element 510, element 518 and element 520 form an X shape, with each element protruding away from the central point of the X. The X shape allows these elements to be contiguously connected along the diagonals, thereby enabling electrical continuity between the elements and to provide mutual coupling desirable in wideband elements. Since elements may be closely packed together and electrically touching, mutual coupling may be planned for in the design of the element and used to enhance performance rather than degrade it. Low mutual coupling may cause the elements to behave more as isolated antenna elements and exhibit more resonant behavior. Each element of array 500 may include one excitation port, for example, element 504 includes excitation port 506 and element 510 includes excitation port 512. While not shown in FIG. 5, a conductive wall (e.g., similar to conductive wall 302 shown in FIG. 3) may be used in array 500.

Figure 6:
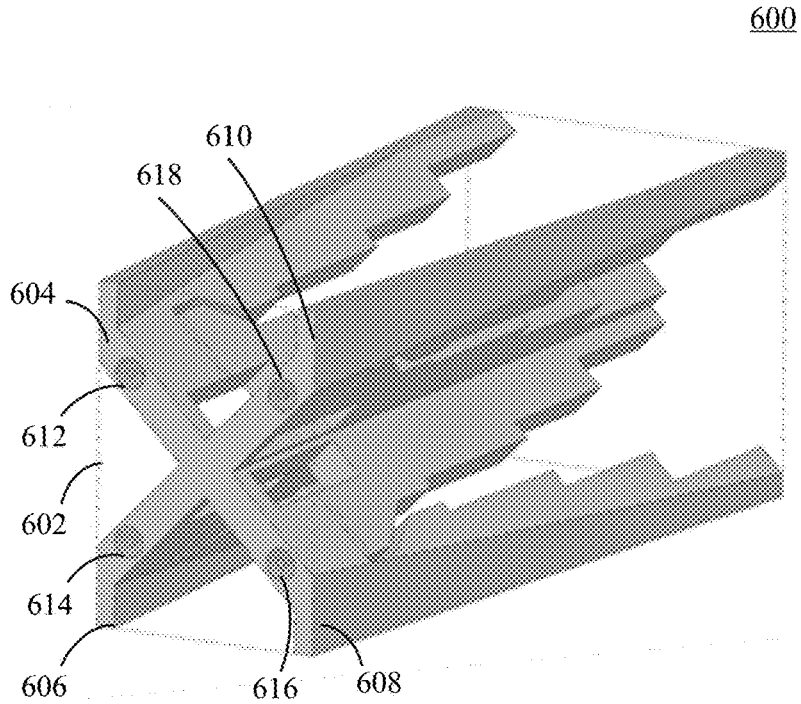
FIG. 6 depicts an exemplary quadrature-type antenna element in a perspective view.

Other antenna elements may be used in the described antenna configurations instead of the stepped notch element shown in FIG. 2. FIG. 6 depicts an exemplary quadrature-type ("quad-notch") antenna element 600 in a perspective view. Quad-notch element 600 may be used to support dual-polarization in conformal phased arrays, particularly circular and cylindrical. Quad-notch element 600 conforms to a wedge-shaped cell 602. Quad-notch element 600 includes four tips 604, 606, 608 and 610 extending into four corners of cell 602 to form an X shape on a front face of cell 602. Quad-notch element 600 includes four excitation ports 612, 614, 616 and 618 corresponding to tips 604, 606, 608 and 610, respectively.

Figure 7:
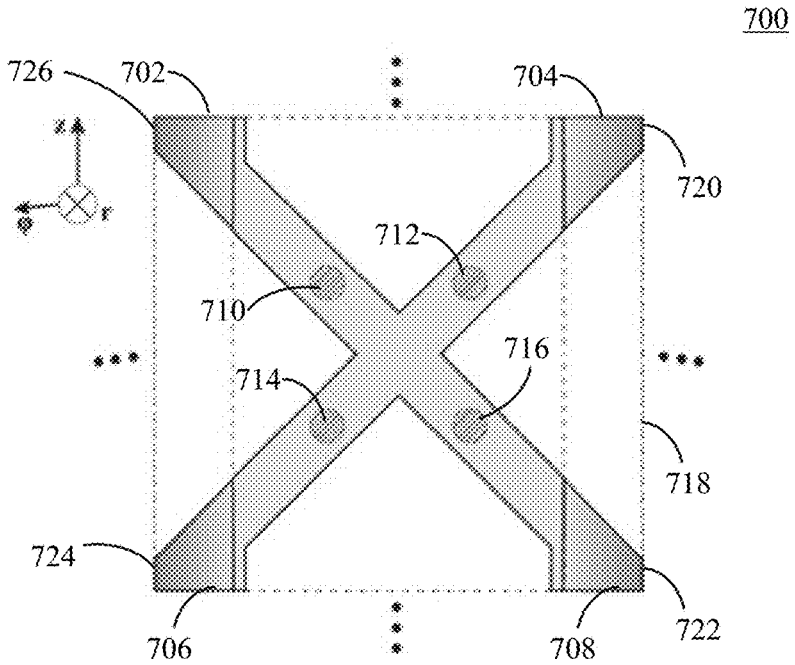
FIG. 7 depicts an exemplary quadrature-type antenna element in an orthogonal view.

FIG. 7 depicts an exemplary quadrature-type antenna element 700 in an orthogonal view. Quad-notch element 700 may be an implementation of quad-notch element 600. Quad-notch element 700 includes four tips 702, 704, 706, and 708, each including one excitation port 710, 712, 714 and 716, respectively. As can be seen in FIG. 7, quad-notch element 700 conforms to wedge-shaped unit cell 720 by utilizing conductive extrusions 720, 722, 724, and 726 in the elevation plane (z direction) to ensure electrical continuity between adjacent unit cells and provide structural support, while also retaining a satisfactory circumferential (φ) element spacing (e.g., less than half-wavelength at the high operating frequency). The thickness and shape of these conductive extrusions may vary for both electrical and mechanical design.

Quad-notch elements 600 and 700 provide certain benefits. For example, dual-polarization is enabled with a slant X-type arrangement without truncating one polarization dimension. Necessary electrical contact between adjacent elements is maintained with additional conductive extrusions at the X-shaped tips. The thickness and shape of the conductive extrusions may vary for both electrical and mechanical design. The quad-notch design also enables the half-wavelength circumferential spacing to be maintained with long elements to avoid degradation to beam-steering and pattern-shape.

Figure 8:
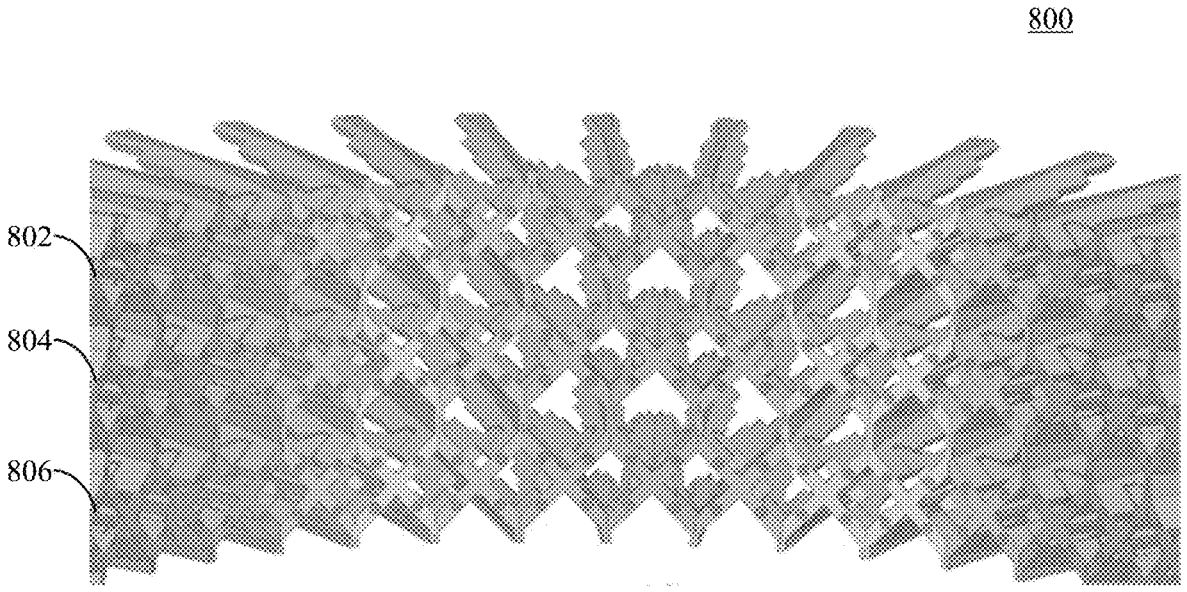
FIG. 8 depicts an exemplary cylindrical array formed with quadrature-type antenna elements in a sectional view.

FIG. 8 depicts an exemplary cylindrical array 800 formed with quadrature-type antenna elements in a sectional view. For example, array 800 may be formed with quad-notch elements 600 or 700 horizontally arranged around a circle forming a tier, and multiple tiers 802, 804, and 806 may be vertically arranged one on top of the other. While not shown in FIG. 8, a conductive wall (e.g., similar to conductive wall 302 shown in FIG. 3) may be used in array 800. In an embodiment, array 800 may be a cylindrical array that operates in a manner similar to array 400 and/or array 500 and provides similar benefits mentioned above with respect to these arrays. Furthermore, array 800 may be a wideband conformal phased array that supports dual-polarization and is configured to form directional beams throughout the full 360 degrees of azimuth coverage.

Aspects of this work are described in Dorsey et al., "3D-Printed Circular Array for WiMAX Base Station," IEEE Antennas and Wireless Propagation Letters, Vol. 18, No. 6, June 2019, 1159-1163, which, is incorporated herein by reference for the purposes of describing techniques for making, testing, and using the conformal phased arrays described herein.

Advantages

Advantages of the antenna configurations described herein include the ability to form high-gain transmit patterns to maximize power delivered to a receive node and the ability to form high gain, low sidelobe level receive patterns to maximize signal-to-noise ratio and mitigate interference. Moreover, transmit and receive patterns may be electronically scanned over a full 360 degrees without degradation to gain or sidelobe level, resulting in no scan loss, no beam broadening, and no polarization degradation with the scan. The antenna configurations are also ideal for 360-degree direction of arrival determination.

The simple construction of the antenna configurations enable them to be machined out of metal or built using additive manufacturing. Circular arrays (e.g., array 100 and array 400) may be seen as modular building blocks that may be assembled to create cylindrical arrays (e.g., array 300, array 500 and array 800) of arbitrary height. Elements/wedges and/or sections of any array may also be manufactured and assembled modularly for convenience. Alternatively, the arrays may be manufactured as whole integrated structures.

The different antenna configuration may be easily scaled from one frequency band to another by varying the element spacing. Furthermore, it is a straightforward extension from single-linear (e.g., vertical, horizontal) to dual-linear polarization (e.g., circular polarization). For example, conductive wall may be placed in between tiers of a cylindrical array to enhance performance, and may be replaced with a second orthogonal polarization to allow the array to extend from single-linear to dual-linear polarization.

Conclusion

While various embodiments of the disclosed subject matter have been described above, it should be understood that they have been presented by way of example only, and not limitation. Various modifications and variations are possible without departing from the spirit and scope of the embodiments as defined in the appended claims. Accordingly, the breadth and scope of the disclosed subject matter should not be limited by any of the above-described exemplary embodiments, but should be defined only in accordance with the following claims and their equivalents.

What is claimed is:

1. A wideband antenna array, comprising:

a first set of antenna elements arranged in a circular manner to form a first tier, each element of the first set of antenna elements having at least one excitation port and is configured to be separately excitable via the at least one excitation port, each element having a notch that has a radiating end that is wider than a feed end; and wherein the wideband antenna array is configurable to operate in at least one of an omnidirectional mode, a sectorized mode, or a high-gain directional mode.

2. The wideband antenna array of claim 1, wherein the wideband antenna array is configured to enable the formation of directional beams throughout 360 degrees of azimuth coverage without degradation to gain or sidelobe level.

3. The wideband antenna array of claim 1, wherein a circumferential spacing of the first set of antenna elements is based on a wavelength of a highest operational frequency of the wideband antenna array.

4. The wideband antenna array of claim 1, wherein a height of each element is based on a wavelength of a highest operational frequency of the wideband antenna array.

5. The wideband antenna array of claim 1, wherein the first set of antenna elements is in a vertical arrangement and supports vertical polarization.

6. The wideband antenna array of claim 1, further comprises:

a second set of antenna elements arranged in a circular manner to form a second tier;

wherein the first tier and the second tier are vertically arranged to form a cylinder.

7. The wideband antenna array of claim 6, further comprises:

a conductive wall between the first tier and the second tier.

8. The wideband antenna array of claim 1, wherein the first set of antenna elements is in a dual-slant arrangement and supports orthogonal slant polarization.

9. The wideband antenna array of claim 8, further comprises:

a second set of antenna elements arranged in a circular manner to form a second tier, the second set of antenna elements being in a dual-slant arrangement;

wherein the first tier and the second tier are vertically arranged to form a cylinder.

10. The wideband antenna array of claim 1, wherein each element comprises a quadrature-type element having four excitation ports and supports dual-polarization.

11. The wideband antenna array of claim 10, further comprises:

a second set of quadrature-type antenna elements arranged in a circular manner to form a second tier;

wherein the first tier and the second tier are vertically arranged to form a cylinder.

12. The wideband antenna array of claim 1, wherein each element is configured to conform to a wedge-shaped unit cell.

13. The wideband antenna array of claim 1, wherein each element is formed with a plastic material and is electroplated.

14. The wideband antenna array of claim 1, wherein each element is formed with a metal.

15. The wideband antenna array of claim 1, wherein the first tier is configured to be formed by one or more modular structures.

16. The wideband antenna array of claim 1, wherein at least the first tier is configured to be formed as an integrated structure.

17. The wideband antenna array of claim 1, wherein each element comprises a stepped notch element.

18. A conformal phased array, comprising:

a plurality of quadrature-type elements, each element conforming to a wedge-shaped cell and comprising a plurality of conductive extrusions that provide mechanical support and continuity between adjacent elements;

wherein the conformal phased array is configured to form directional beams throughout 360 degrees of azimuth coverage.

19. The conformal phased array of claim 18, wherein each element further comprises a plurality of excitation ports to support dual-polarization.

20. The conformal phased array of claim 18, wherein the conductive extrusions are in the elevation plane.

* * * * *